US006766820B1

(12) United States Patent
Hoss

(10) Patent No.: US 6,766,820 B1
(45) Date of Patent: Jul. 27, 2004

(54) FIELD ADJUSTABLE PILOT GUARD

(75) Inventor: Maurice Hoss, Lafayette, LA (US)

(73) Assignee: FMC Technologies, Inc., Chicago, IL (US)

( * ) Notice: Subject to any disclaimer, the term of this patent is extended or adjusted under 35 U.S.C. 154(b) by 166 days.

(21) Appl. No.: 09/927,446

(22) Filed: Aug. 9, 2001

(51) Int. Cl.[7] ..... F16K 31/66; F23N 5/10; F23N 5/24; F23Q 9/08

(52) U.S. Cl. ..... 137/66; 251/73; 251/74; 251/129.15; 251/368; 251/113; 431/54; 431/77; 431/80; 431/84

(58) Field of Search ..... 137/65, 66; 431/54, 431/75, 76, 77, 78, 80, 111, 83, 84; 251/129.15, 129.16, 368, 113, 68, 69, 72, 73, 74

(56) References Cited

U.S. PATENT DOCUMENTS 2,236,227 A * 3/1941 Wantz ..... 137/66
2,253,670 A * 8/1941 Wetzel et al. ..... 137/66
2,953,198 A * 9/1960 Hajny ..... 137/66
3,445,174 A * 5/1969 Mathews ..... 137/66
5,050,840 A * 9/1991 Kondo et al. ..... 251/129.15
5,931,655 A * 8/1999 Maher, Jr. ..... 431/80
5,967,766 A * 10/1999 Katchka ..... 137/66
6,065,484 A 5/2000 Bartel et al. ..... 137/66
6,367,433 B2 * 4/2002 Oyama et al. ..... 251/129.16
6,496,092 B1 * 12/2002 Schnatterer et al. ... 251/129.16

* cited by examiner

*Primary Examiner*—George L. Walton
(74) *Attorney, Agent, or Firm*—Andrew J. Cornelius

(57) ABSTRACT

An improved pilot guard for controlling the flow of gaseous fuel to both a pilot burner and a main burner, the pilot valve comprising a housing having an inlet port, a pilot port and a main burner port; a bore extending through the housing between the pilot port and main burner port; a stop shuttle normally biased to a seated position in which it blocks communication between the inlet port and the bore; a reset shuttle positioned in the bore for lifting the stop shuttle from its seated position, the reset shuttle supporting a sealing member for sealing the inlet port from the main burner port but permitting communication between the inlet port and the pilot port when the reset shuttle lifts the stop shuttle from its seated position; a thermocouple capable of generating a current from the heat of the pilot burner; an electromagnet connected to the thermocouple and capable, when fully energized, of holding the stop shuttle from moving to its seated position; wherein the reset shuttle is movable by the force of gas pressure from the inlet port to a position in which the sealing member permits both the main burner port and the pilot port to communicate with the inlet port, and a potentiometer that is used to adjust the current that is applied to the electromagnet by the thermocouple.

15 Claims, 4 Drawing Sheets

FIELD ADJUSTABLE PILOT GUARD

BACKGROUND OF THE INVENTION

The present invention relates to pilot valves and, more particularly, to a guard for a pilot valve.

Automatic safety systems employing guards for pilot valves, which are also called pilot guards, are often used to control burners within fired equipment, such as to heat crude oil that has been collected in vessels in order to facilitate the separation of water droplets from the crude, which may be deployed in remote locations and be unattended (the word "control" as used herein simply means on-off accessibility to the fuel supply, i.e., access to the fuel supply is permitted in the "on" position and is precluded in the "off" position; whether fuel is actually directed to the main burner is determined by another valve, responsive to its own thermostat, interposed between this burner and the pilot guard). Such systems for both the pilot and main burner are required to avoid accumulation within the fired equipment of raw fuel discharged by unlit burners in volumes sufficient to be an explosive hazard. Because the collection vessels may be remotely located, a source of electrical power is often unavailable, or if available, is not reliable. To avoid reliance on electrical power in a control means, prior art pilot guards have utilized materials, such as mercury, which expand greatly when heated. Such arrangements are not desirable because the materials are often toxic, are susceptible to leakage, and since they have a relatively large mass from which heat must be dissipated after the removal of heat, do not react rapidly to failure of the flame being sensed. Many of these prior art devices that did use a thermocouple provided no means for emergency shutdown or means for testing the operation of the safety system.

U.S. Pat. No. 6,065,484 ("484") discloses a burner and pilot guard safety and control system that provides a pilot guard having a stop shuttle normally biased to a seated position to completely block communication with a source of natural gas under pressure and a reset shuttle movable to a reset or start up position in which it unseats the stop shuttle while simultaneously permitting communication of the pilot burner with the gas source and blocking communications with the main burner. A reset latch is arranged to hold the reset shuttle in its reset position until released. A thermocouple capable of producing a voltage output proportional to its temperature is heated by the flame of the pilot burner and is connected to an electromagnet. The electromagnet, when fully energized, holds the stop shuttle in its unseated position. When the reset latch is released, the reset shuttle is then moved by the force of the gas pressure to an operational position in which both the pilot and main burners are in communication with the gas source. A momentary contact switch is arranged, when depressed to its closed position, to short circuit the thermocouple. When the thermocouple is short circuited, the holding force of the electromagnet immediately deteriorates and the stop shuttle is instantly biased to its seated position blocking all communication with the gas source.

The pilot guard that is disclosed in 484 works well in many applications. However, in some applications, the heat generated by the pilot flame is not adequate to energize the electromagnet sufficiently to allow it to hold the pilot guard assembly open after the pilot flame is lit. Consequently, in these applications, both the pilot guard assembly and the main burner valve assembly within the pilot guard will never "latch in" and will shut down upon release of the reset shuttle in the event of inadequate heat generated by the pilot flame. This condition of insufficient pilot flame heat could have several causes, including low BTU gas, excessive amounts of secondary air through the fire tube, low pilot pressure, and improper thermocouple alignment. Additionally, a pilot flame that is too hot could increase the time needed to de-energize the electromagnet and consequently shut off the pilot and burner gas upon occurrence of a flame-out to dangerous levels.

Therefore, there is a need for a pilot guard that overcomes the deficiencies of the prior art in handling the problems posed by the variable levels of heat produced by pilot flames.

SUMMARY OF THE INVENTION

The present invention provides a pilot guard that is safer and more adaptable than prior art guards, and that has improved gas supply shut-off times in the event of a loss of pilot flame. The present invention can be adjusted in the field to accommodate a variety of levels of heat produced by pilot flames. In the preferred embodiment of the present invention described below, the adjustment is provided by a potentiometer.

DESCRIPTION OF THE DRAWINGS

The following description of the preferred embodiment may be understood better if reference is made to the appended drawing, in which.

DETAILED DESCRIPTION OF THE PREFERRED EMBODIMENT

Figure 1:
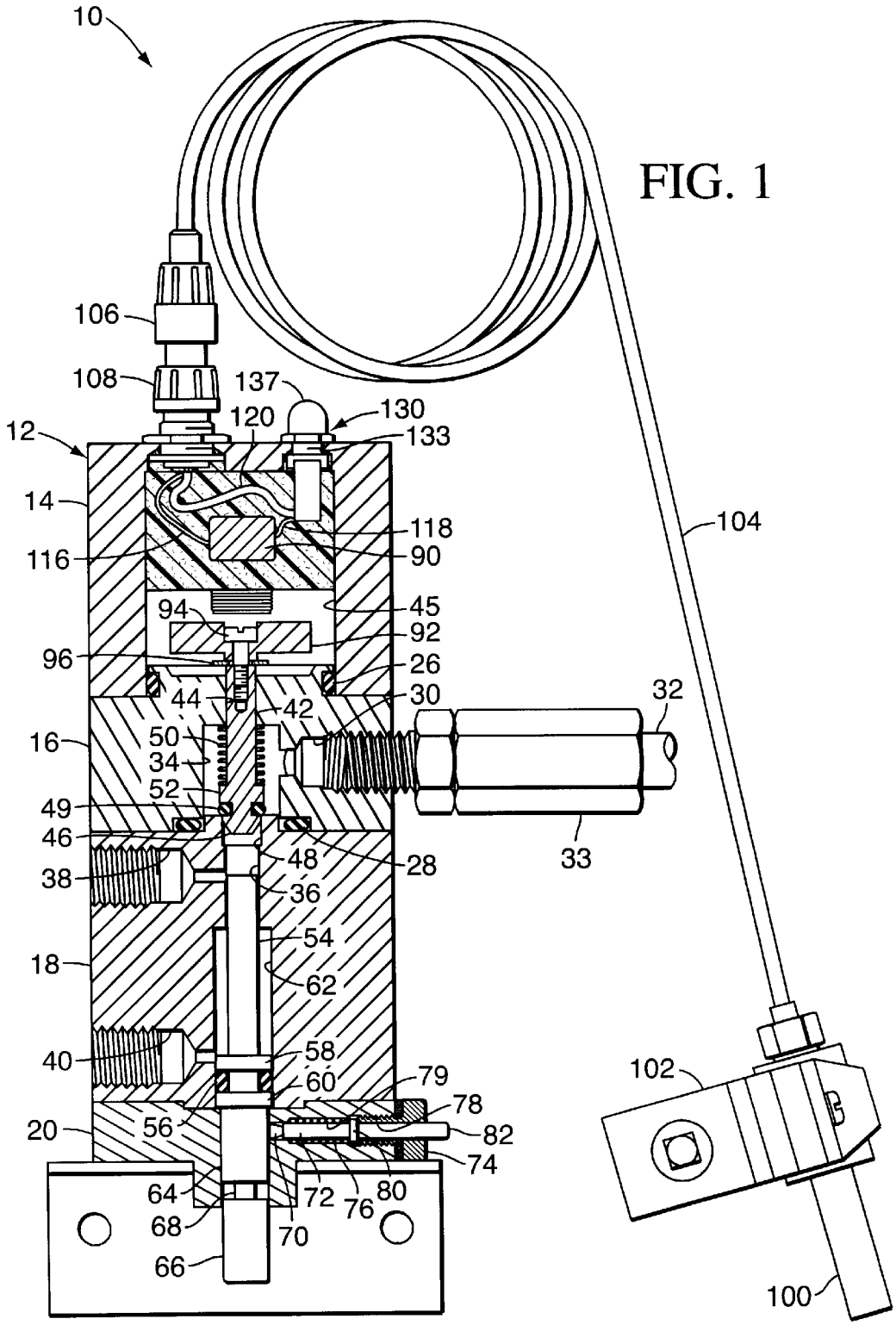
FIG. 1 is an elevational cross section of a pilot guard for use in an automatic safety control system according to the present invention.
Figure 2:
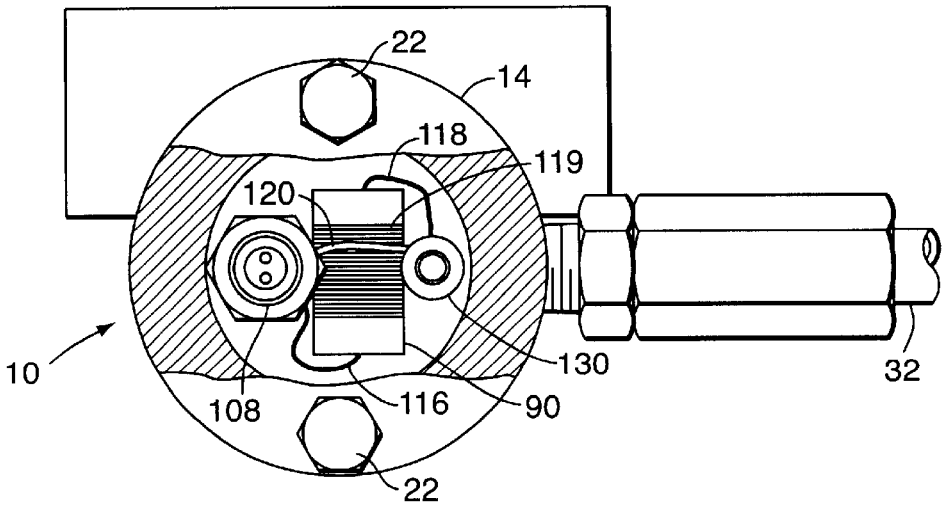
FIG. 2 is a top plan view of the guard shown in FIG. 1 with portions thereof broken away for clarity.
Figure 3:
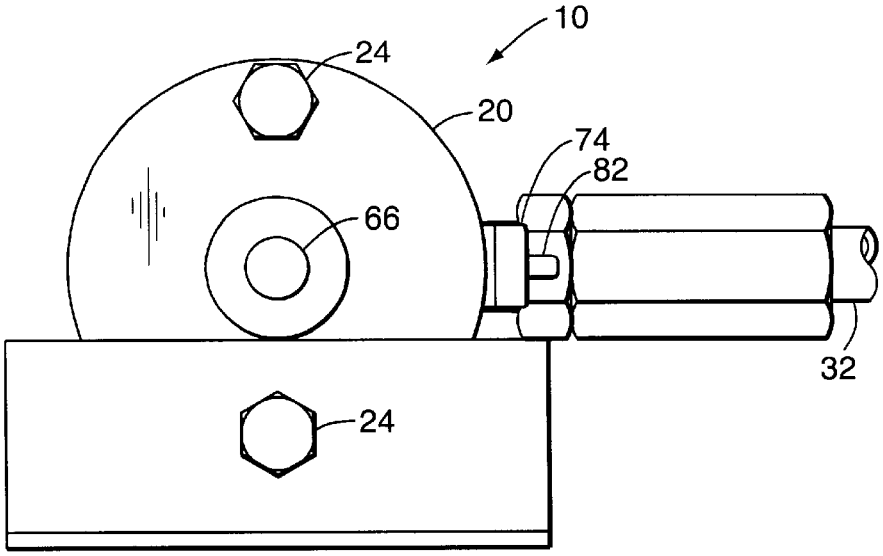
FIG. 3 is a bottom plan view of the pilot guard shown in FIG. 1.

Referring to FIGS. 1 through 5, there is shown a pilot guard indicated generally at 10, having a body 12, which for ease of manufacture and assembly is composed of an electromagnet housing 14, an inlet disc 16, an output disc 18, and a bottom cover disc 20 all of which are joined together as a unitary structure by screws 22, shown in FIG. 2, that extend through aligned holes in the electromagnet housing 14 and the inlet disc 16 to engage tapped holes in the output disc 18, and by screws 24, shown in FIG. 3, that extend through holes in the bottom cover disc 20 to engage the same tapped holes. An O-ring seal 26 positioned in a peripheral groove in the inlet disc 16 contacts the inner diameter of the electromagnet housing 14 to prevent the escape of gas between the housing 14 and the inlet disc 16. Another O-ring seal 28 is positioned between the output disc 18 and the inlet disc 16 to prevent the escape of gas between the adjacent surfaces of the inlet and output discs 16 and 18 respectively. The inlet disc 16 is provided with an inlet port 30 which is arranged in a conventional manner to connect with a natural gas supply line 32 through an in-line filter 33, which may be any of the commercially available types, such as a sintered bronze filter, for example, for removal of water and solid contaminates that could otherwise interfere with the proper operation of the pilot guard 10. The inlet port 30 communicates with a central cavity 34 formed in the inlet disc 16. A central longitudinal bore 36 in the outlet disc 18 communicates with the cavity 34 and with a pilot port 38 and a main burner port 40. A stop shuttle 42 extends through and reciprocates in a central bore 44 in the inlet disc 16. The diameter of central bore 44 is slightly larger than the diameter of shuttle 42 to ensure that pressure in central bore 44 is always equal to that in bore 45 defined by housing 14. The lower end 46 of the shuttle 42 is frusto-conically shaped for engagement with a counterbore 48 to assure alignment of the longitudinal axis of the shuttle 42 with the bore 36. An O-ring 49 carried in a groove in the shuttle 42 is engageable with the intersection of the counterbore 48 with the upper surface of the output disc 18 to block communication between the cavity 34 and the bore 36. A compression spring 50 trapped between the inlet disc 16 and a collar 52 on the shuttle 42 urges the O-ring 49 into sealing engagement with the outlet disc 18. As the O-ring 49 is deformed by the force of the spring, i.e., takes a permanent set, the lower end 46 will simply travel downward further, so the sealing capability of the O-ring 49 is retained.

A reset shuttle 54 is reciprocal in the bore 36 but with sufficient clearance to permit an adequate flow of gas therebetween to provide the fuel requirement of both the pilot and main burners. An O-ring seal 56 is carried between lands 58 and 60 formed on the reset shuttle 54, which lands 58 and 60 engage and reciprocate in a counterbore 62. The engagement of the lower land 60 with the upper surface of the bottom cover disc 20 limits the downward travel of the reset shuttle 54, in which position the seal 56 is below the main burner port 40 permitting communication of the bore 36 with the port 40. An extension 64 is formed on the reset shuttle 54 and extends through a bore in the bottom cover disc 20, the lower end of which protrudes to function as a reset button 66. Pushing upward on the reset button 66 first causes the O-ring 56 to isolate the burner port 40 and then the upper face of the shuttle 54 to engage the end 46 to push the stop shuttle 42 upward, against the bias of the spring 50, disengaging the O-ring 49 from its seat. Communication between the inlet port 30 and the pilot port 38 is thereby established.

A groove 68 is formed in the extension 64 and is engageable by the inner end 70 of a latch pin 72 which is reciprocably retained in a radial bore 79 in the bottom cover disc 20 by a bushing 74 that is screwed into a threaded counterbore 78 in the disc 20, and that bears against a collar 80 formed on latch pin 72. A compression spring 76 is trapped between the bottom of the bore 79 and collar 80 and urges the pin 72 toward the right, as viewed in FIG. 1, so that the inner end of the latch pin 72 clears the extension 64 and the opposite end thereof protrudes beyond the bushing 74 to function as a latch button 82. The inner end 70 of the latch pin 72 has a frustroconical shape with the largest diameter at the extreme end thereof A complementary shape is provided to the upper surface of the groove 68 so that the force of the compression spring 50 will retain the inner end 70 of the latch pin 72 within the groove 68, when upward manual force on the reset button 66 is released before the release of inward manual force on the latch button 82, to hold the reset shuttle 54 in the raised position previously described, i.e., with the inlet port 30 in communication with the pilot port 38 but with the main burner port 40 isolated from the inlet port 30. Gas is thereby permitted to flow to the pilot but not to the main burner. Subsequently manually pushing the reset button 66 upward, without any force being applied to latch button 82, will permit compression spring 76 to release the end 70 from the groove 68. Upon release of such upward manual force on the reset button 66, the downward force of the gas pressure acting on the reset shuttle 54 will cause shuttle 54 to move downward until the land 60 engages the upper surface of bottom disc cover 20. In this position of the reset shuttle 54, the bore 36 is in communication with both ports 38 and 40. Gas would thereafter be supplied to both ports 38 and 40 if, and only if, the stop shuttle 42 did not move downward under the force of the compression spring 50 so that the O-ring seal 49 precludes communication between the inlet port 30 and the bore 36.

Figure 5:
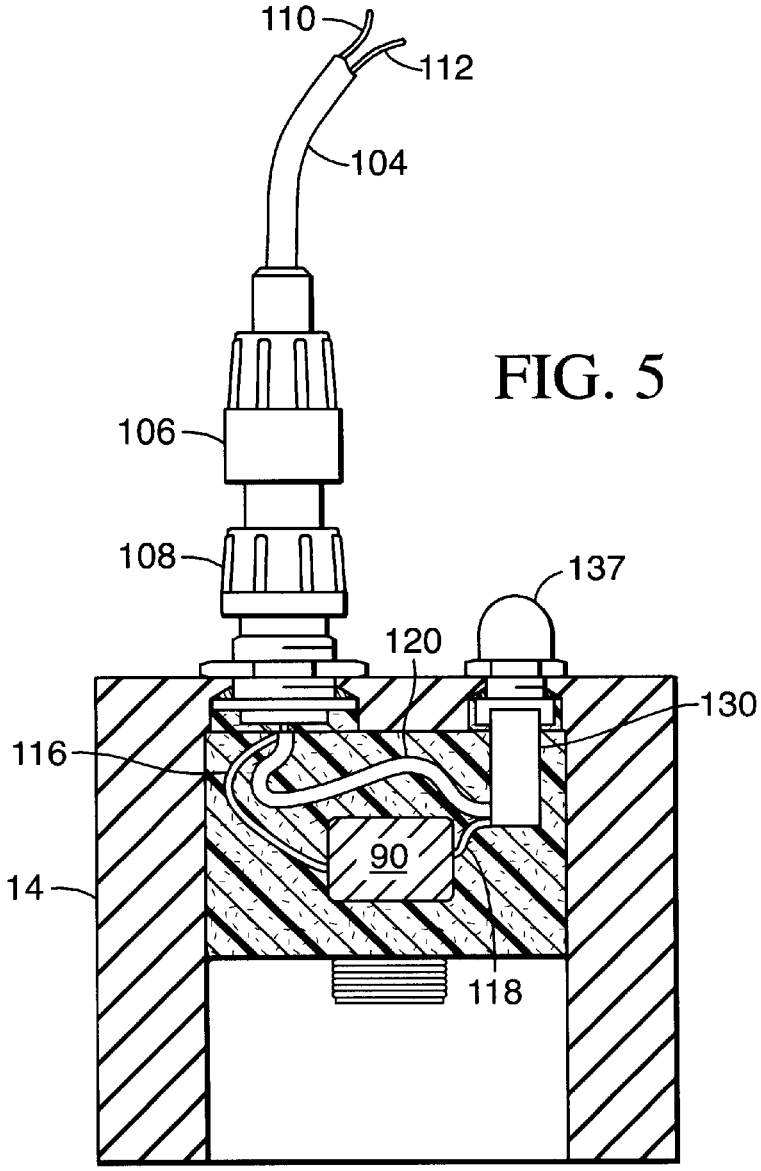
FIG. 5 is an enlarged view of the electromagnet housing and part of the thermocouple of the pilot guard shown in FIG. 1.
Figure 6:
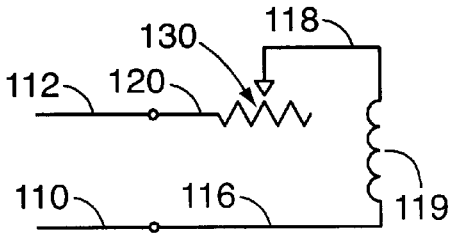
FIG. 6 is a schematic diagram of the electrical components of the pilot guard shown in FIG. 1.

The stop shuttle 42 will move downward only if a horseshoe electromagnet 90 is not energized. A disc 92, which is made of a magnetic material, is attached to the top of the stop shuttle 42 by a screw 94 extending through washer 96. When electromagnet 90 is energized, the disc 92 will be held by magnetic attraction thereagainst, holding the stop shuttle 42 in its upward, open position against the bias of the spring 50. The electromagnet 90 is energized by a thermocouple 100, which is held by a suitable bracket 102 in a position to be heated by the flame of the pilot burner (not shown). Referring to FIGS. 2 and 5, lead wires 110 and 112 from the thermocouple 100 extend through a flexible sleeve 104 and terminate in a connector 106 which mates with a complementary socket 108 secured to the top of the electromagnet housing 14. Wire 110 from thermocouple 100 connects with wire 116 leading from one terminal of socket 108, and is connected to one terminal of the windings 119 of electromagnet 90. Wire 112 is connected to wire 120 leading from the remaining terminal of socket 108, and is connected to one terminal of a potentiometer 130, which is mounted in any suitable fashion to the top of housing 14. Potentiometer 130 can be a 100 ohm, 20 turn potentiometer manufactured by Spectrol, 4501 Greystone Drive, Ontario, Calif. 91761 as part no. 043P101 (and available from Mouser Electronics, Inc., 1000 North Main Street, Mansfield, Tex. 75063, 800-346-6873, as part no. 594-43P101). The resistance of potentiometer is decreased by turning it in the counterclockwise direction and increased by turning it in the clockwise direction. Wire 118 from the remaining terminal of windings 119 of electromagnet 90 is connected to the second terminal (or wiper) of potentiometer 130, thus completing the series connection of the electromagnet 90, potentiometer 130 and thermocouple 100. FIG. 6 shows this arrangement schematically. Electromagnet 90, potentiometer 130, and connectors 116, 118 and 120 are potted within housing 14 as shown in FIG. 5.

Figure 4:
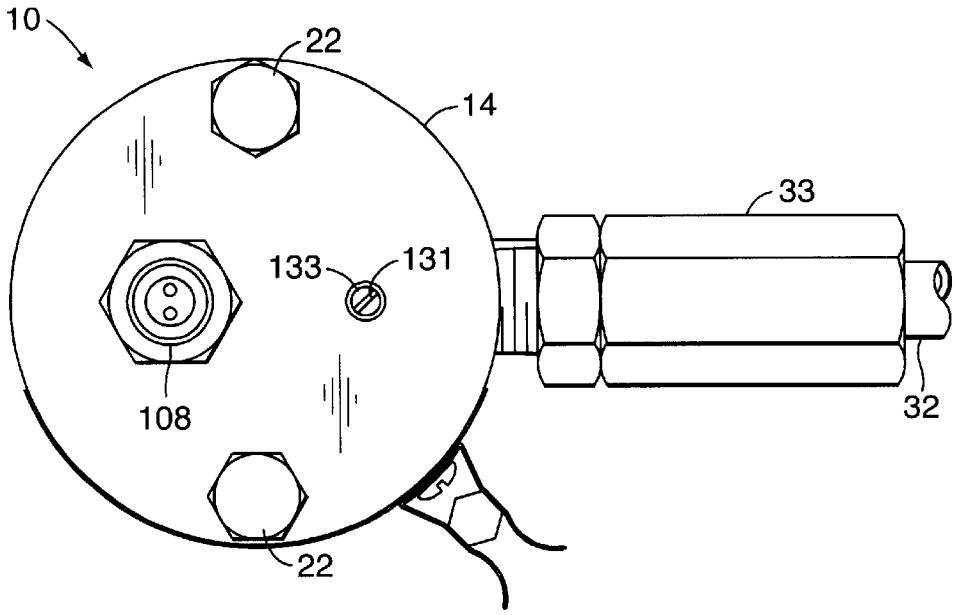
FIG. 4 is a top plan view of the pilot guard shown in FIG. 1, with the acorn nut removed from the potentiometer.

When thermocouple 100 is heated by the flame of the pilot burner, it will generate a voltage across wires 110 and 112. Potentiometer 130 is adjusted to allow enough current to pass through windings 119 to cause electromagnet 90 to hold stop shuttle 42 in its upper position, in which natural gas is provided to both main burner port 40 and pilot burner port 38. Referring to FIG. 4, potentiometer 130 is adjusted in well-known fashion by unthreading acorn nut 137 from post 133 of potentiometer 130 and inserting the blade of a screwdriver into slot 131 defined by post 133 of potentiometer 130, and rotating the screwdriver to rotate post 133 about its longitudinal axis. If the resistance of potentiometer 130 is set too high, the current through windings 119 will be reduced to a level that is insufficient to allow electromagnet 90 to produce sufficient magnetic force to hold mating disk 92 against the opposing force of compression spring 50 in its upper position. Thus, O-ring 49 will prevent the flow of gas to both ports 38 and 40, and neither the pilot burner nor the main burner will receive gas. Also, main burner port 40 also will not receive gas if the pilot flame is extinguished, the thermocouple 100 is not positioned properly in the pilot flame, or thermocouple 100 is defective. In all these cases, thermocouple 100 will not produce any significant voltage to the circuit shown in FIG. 6, and gas can never be supplied to main burner port 40.

It has been discovered that using sintered metal oxide ferrite for the core of the horseshoe electromagnet 90 and sintered phosphorous iron (available, for example, as product number PSP-45 from Sintered Parts, LLC, of Tulsa Oklahoma) for the disc 92 will produce a magnetic force sufficient to hold the stop shuttle 42 against the bias of the spring 50 even at the low voltage and current output of a conventional thermocouple. A thermocouple producing an output voltage of 600 to 750 millivolts and a current of 100 milliamps has been found to reliably hold the stop shuttle 42 against a spring force of two pounds.

While the pull-in force, i.e., the magnetic force attracting the disc 92 toward the magnet 90 when an air gap exists between them, with the described arrangement is small, the holding force, i.e., the magnetic force generated when these two elements are in contact with each other, has been found to be quite large. The reason is that, when in contact, the disc 92 completes a magnetic circuit between the ends of the horseshoe magnet 90, efficiently transferring the magnetic flux therebetween. Holding force, rather than pull-in force, is important since the disc 92 will be moved into contact with the ends of the electromagnet 90 by the manual upward movement of the reset button 66 to permit release of the latch pin 72. The groove 68 is positioned so that when the end 70 of the latch pin 72 is in engagement therewith a small air gap exists between the disc 92 and the ends of the electromagnet 90. Subsequent manual upward movement of the reset button 66, which is necessary to release the latch pin 72, will close this gap.

The pilot guard 10 with the thermocouple 100 properly positioned by attachment of the bracket 102 to be heated by the flame of a pilot burner, is placed in operation by initially introducing an ignition source adjacent the pilot burner. The reset button 66 is then depressed, i.e., manually moved upwardly, while simultaneously depressing the latch button 82, i.e., manually urging the latch button 82 inward. When the operator feels the inner end 70 move into the groove 68, the reset button 66 is released, while pressure on the latch pin is, at least momentarily, maintained. The engagement of the tapered end 70 with the upper surface of the groove 68 will retain the latch pin 72 in the groove 68 holding the reset shuttle 54 in an elevated position in which the stop shuttle 42 is unseated and only the pilot port 38 is provided with gas. The force of the gas pressure acting on the reset shuttle 54 and the force of the spring 50 will retain the end 70 within the groove. Once the thermocouple 100 is heated, the potentiometer 130 is adjusted such that the current supplied to electromagnet 90 is just above the latch-in current. Upon setting the potentiometer 130, the reset button 66 is depressed again, with no force being applied to latch button 82. The spring 76 will cause the latch pin to move outward extracting the end 70 from the groove 68 and allowing gas pressure to move the reset shuttle 54 downwardly connecting both the pilot port 38 and the main burner port 40 to be supplied with gas. Of course, this assumes the thermocouple 100 has produced sufficient voltage to energize the electromagnet 90 in order for magnetic force to hold the stop shuttle 42 in its unseated position. If the pilot flame has failed, or if the thermocouple is defective or improperly positioned, the spring 50 will immediately return the stop shuttle 42 to its seated position blocking all communication with the gas source. While the pull in, or latch in, and drop out currents for the guard will depend on the configuration of the guard and are readily ascertainable for those of ordinary skill in the art, latch in currents of 65 to 75 milliamps, and drop out currents of 40 to 45 milliamps are typical for common configurations.

A typical method of operating follows:

Clear the area of combustibles;

Close shut-off valves in the main burner line and pilot line, and wait for gas to vent from the system;

Decrease the effective resistance of potentiometer 130 by turning potentiometer 130 20 turns counterclockwise;

Stand to the side of the burner and light a torch; insert the torch into the fire tube next to the pilot burner;

Open the pilot shut off valve;

Depress reset button 66 until it and reset shuttle 54 latches to allow gas to flow to the pilot burner and ignite the pilot;

When thermocouple 100 comes up to temperature (usually 60 to 90 seconds after ignition), fully depress and then slowly release reset button 66, at which point pilot guard 10 should latch in the open position, allowing gas to flow to both the pilot port 38 and main burner port 40;

Increase the resistance of potentiometer 130 by (a) slowly turning potentiometer 130 clockwise until pilot guard 10 drops out (disc 92 becomes disengaged from magnet 90), (b) turning potentiometer 130 counterclockwise 4 turns, (c) relight the pilot by following the preceding steps, except that the potentiometer is not turned 20 turns in the counterclockwise direction;

If unable to latch pilot guard 10 in the open position, turn potentiometer 130 1 more turn in the counterclockwise direction, and repeat this procedure until pilot guard 10 remains latched open, and then turn potentiometer 130 2 turns in the clockwise direction;

This procedure should result in a 12 to 20 second shut down time after loss of pilot flame. To obtain a shorter drop out time, slowly turn potentiometer 130 clockwise to find the maximum number of turns that can be made before pilot guard 10 drops out;

Slowly open the manual shut-off valve to the main burner line to light the main burner;

Test for proper operation by extinguishing the pilot flame and, with the manual shut-off valve to the pilot open, observing that gas pressure to the pilot and main burner control is shut off within 45 seconds; to shorten the drop out time, slowly turn potentiometer 130 further in the counterclockwise direction; use the foregoing procedure to relight the burner.

While a preferred embodiment of the present invention has been illustrated and described herein, it is to be understood that various changes may be made therein without departing from the spirit of the invention, as defined by the scope of the appended claims.

What is claimed is:

1. A pilot guard for controlling the flow of gaseous fuel to both a pilot burner and a main burner comprising:

a housing having an inlet port, a pilot port, and a main burner port;

a bore extending through said housing between said pilot port and said main burner port;

a stop shuttle normally biased to a seated position in which it blocks communication between said inlet port and said bore and prevents the flow of gaseous fuel to both said pilot port and said main burner port;

a reset shuttle positioned in said bore for lifting said stop shuttle from its seated position, said reset shuttle supporting a sealing member for sealing the inlet port from the main burner port but permitting communication between said inlet port and said pilot port when said reset shuttle lifts said stop shuttle from its seated position;

a thermocouple capable of generating a voltage from the heat of the pilot burner;

an electromagnet connected to said thermocouple and capable, when energized by a predetermined current produced by said thermocouple, of holding said stop shuttle from moving to its seated position; and a current adjustor connected between said thermocouple and said electromagnet by which the current applied to said electromagnet by said thermocouple can be adjusted;

said reset shuttle being movable by the force of gas pressure from said inlet port to a position in which said sealing member permits both said main burner port and said pilot port to communicate with said inlet port:

whereby, said stop shuttle moves to said seated position when said thermocouple does not produce at least said predetermined current to said electromagnet.

2. The invention according to claim 1, and further comprising a disc secured to said stop shuttle and made of a material capable of being magnetically held by said electromagnet when energized.

3. The invention according to claim 2, wherein said material is sintered phosphorous iron.

4. The invention according to claim 3 wherein said electromagnet has a horseshoe-shaped core made of a ferrite material.

5. The invention according to claim 4 wherein said ferrite material is a sintered metal oxide ferrite.

6. The invention according to claim 2 wherein said material is sintered phosphorous iron.

7. The invention according to claim 1 and further comprising a latch pin for engagement with said reset shuttle to hold said reset shuttle in its unseated position.

8. The invention according to claim 7 and further comprising a spring for normally biasing said latch pin to an outward position out of engagement with said reset shuttle.

9. The invention according to claim 1 wherein said latch pin has a tapered inner end and said reset shuttle has a groove with a surface complementary to said end for holding the latch pin against the bias of said spring.

10. The invention according to claim 9, wherein said disc is spaced from said electromagnet when said latch pin is in engagement with said reset shuttle and subsequent upward movement of said reset shuttle brings said disc into contact with said electromagnet while simultaneously permitting said latch pin to disengage from said reset shuttle.

11. The invention according to claim 1, wherein said current adjustor is a potentiometer.

12. A pilot guard for controlling the flow of gaseous fuel to both a pilot burner and a main burner comprising:

an inlet port in communication with each of a pilot port and a main burner port;

a stop adapted to move between a closed position in which it blocks communication between said inlet port and said pilot and main burner ports and prevents the flow of gaseous fuel to both said pilot port and said main burner port, and an open position in which it does not block communication between said inlet port and said pilot and main burner ports;

an electromagnetic device configured to hold said stop in said open position when a current of at least a predetermined level is applied to said electromagnetic device;

a thermal transducer mounted to produce a current in response to a flame produced by the pilot burner, said thermal transducer being electrically connected to said electromagnetic device to apply said current to said electromagnetic device; and a current adjustor operably connected between said electromagnetic device and said thermal transducer to permit adjustment of the current applied by said thermal transducer to said electromagnetic device; and whereby, said stop moves to said seated position when said thermocouple does not produce a current of at least said predetermined level to said electromagnet.

13. The pilot guard recited by claim 12 wherein said electromagnetic device is an electromagnet.

14. The pilot guard recited by claim 13 wherein said thermal transducer is a thermocouple.

15. The pilot guard recited by claim 14 wherein said current adjustor is a potentiometer.

* * * * *